US010213799B1

(12) United States Patent
Roczey

(10) Patent No.: US 10,213,799 B1
(45) Date of Patent: Feb. 26, 2019

(54) MULTI-USE PORTABLE HAND-HELD SPRAYER

(71) Applicant: Edward Lee Roczey, Alpine, CA (US)

(72) Inventor: Edward Lee Roczey, Alpine, CA (US)

( * ) Notice: Subject to any disclaimer, the term of this patent is extended or adjusted under 35 U.S.C. 154(b) by 0 days.

(21) Appl. No.: 15/845,375

(22) Filed: Dec. 18, 2017

(51) Int. Cl.
*B05B 9/043* (2006.01)
*B05B 9/08* (2006.01)
*B05B 15/656* (2018.01)

(52) U.S. Cl.
CPC ..... *B05B 9/0861* (2013.01); *B05B 9/043* (2013.01); *B05B 15/656* (2018.02)

(58) Field of Classification Search
CPC ..... B05B 9/043; B05B 9/085; B05B 9/0855; B05B 9/0861
See application file for complete search history.

(56) References Cited

U.S. PATENT DOCUMENTS 3,565,344 A * 2/1971 Takei ..... A45D 34/02 239/332
3,901,449 A * 8/1975 Bochmann ..... B05B 15/652 239/332
3,904,116 A * 9/1975 Jones ..... B05B 9/0866 222/333
4,033,511 A * 7/1977 Chamberlin ..... B05B 7/2416 239/346
4,621,770 A * 11/1986 Sayen ..... B05B 1/16 239/304
4,925,105 A * 5/1990 Lin ..... B05B 9/0861 222/175
5,014,884 A * 5/1991 Wunsch ..... B05B 9/0861 222/333
5,150,841 A * 9/1992 Silvenis ..... B05B 7/0018 137/512.4
6,554,211 B1 * 4/2003 Prueter ..... B05B 9/0861 239/332
2004/0118940 A1 * 6/2004 Lavitt ..... A01G 25/145 239/302
2012/0223160 A1 * 9/2012 Goodwin ..... B05B 9/0861 239/332
2016/0296956 A1 * 10/2016 Bailey ..... B05B 9/01

* cited by examiner

*Primary Examiner* — Ryan A Reis
(74) *Attorney, Agent, or Firm* — Richard D. Clarke

(57) ABSTRACT

The present application is directed to a cordless Multi-Use Portable Hand-Held Sprayer with a pump connected to an electric motor which is powered by a rechargeable battery that has been designed to produce a continuous spray from an internal liquid on-board liquid containing reservoir, or from external liquid sources through a suction tube when larger quantities of liquid are required, followed by a positive shut-off. It is made from non-corrosive materials that will not be affected by fluids containing salts or acids. More particularly, a battery powered multi-use portable Hand-Held sprayer device is provided which can be constructed in multiple sizes, mini, small, medium and large, for multiple uses, and configured to pick-up liquid from any liquid source, as well as configured to hold any liquid in an internal reservoir. The unit's nozzle is adjustable from a fine mist to a strong direct line spray.

20 Claims, 6 Drawing Sheets

MULTI-USE PORTABLE HAND-HELD SPRAYER

FIELD OF THE INVENTION

This application relates to the field of cordless, Hand-Held sprayers that have the ability to dispense a wide variety of different kinds of liquids from household products to medical products and personal hygiene cleaning products from an external source through a suction tube or from an internal liquid container. More particularly, a battery powered multi-use portable Hand-Held sprayer device is provided which can be constructed in multiple sizes and configured to pick-up liquid from any liquid source, as well as configured to hold liquid in an internal reservoir.

BACKGROUND OF THE INVENTION

In the past liquids being sprayed were packaged using aerosol propellant as a delivery means. These convenient sprays, however, have been determined to pose a possible hazard to the human race, and are being phased out. Some liquids in the medical field cannot use aerosol propellants as a means of delivery. One substitute is a "pump"-type sprayer, in which the operator depresses the spray nozzle with an attached pump mechanism. This device eliminates the need for factory pressurization but does not meet the requirements achieved by the Multi-Use Portable Hand-Held Sprayer. Many personal hygiene spraying devices are on the market but do not offer the portability and capabilities featured in this unique design.

The Multi-Use Portable Hand-Held Sprayer has been designed to produce a continuous spray from an internal or external liquid container for as long as desired, followed by a positive shut-off. This is accomplished without the need for pressurization by utilizing a pump connected to an electric motor which is powered by a rechargeable battery.

Numerous innovations for spraying devices have been provided in the prior art that art described as follows. Even though these innovations may be suitable for the specific individual purposes to which they address, they differ from the present design as hereinafter contrasted. The following is a summary of those prior art patents most relevant to this application at hand, as well as a description outlining the difference between the features of the present Multi-Use Portable Hand-Held Sprayer and those of the prior art.

U.S. Pat. No. 4,033,511 of Edward B. Chamberlin describes a portable atomizer includes a liquid dispenser, a reciprocating pump for supplying compressed air to the dispenser, and a motor for driving the pump. Upon operation of the motor, compressed air is delivered directly to the dispenser from the pump to automatically atomize liquid in the dispenser and instantaneously spray atomized liquid and compressed air from an orifice in the dispenser.

This patent describes a portable atomizer with a reciprocating pump for supplying compressed air to the dispenser. This patent does not have the capability to spray from an internal source or suck liquid from an external source through a suction tube when larger quantities are required.

U.S. Pat. No. 3,993,250 of Alam H. Shure describes an apparatus for spraying a liquid material which includes a pistol gripped housing for a motor driven pump and forming an inlet, a receptacle adapted to be secured to the housing adjacent the inlet and a vacuum system member secured within the receptacle and adapted to be forced into sealing relationship with the inlet when the receptacle is secured to the housing whereby said pump means will force liquid from the receptacle through a nozzle attached to the housing.

This patent describes an apparatus for spraying a liquid material which includes a pistol gripped housing. This patent also does not have the capability to spray from an internal source or suck liquid from an external source through a suction tube when larger quantities are required.

U.S. Pat. No. 4,154,375 of Jacob R. Bippus describes a rechargeable, battery-powered sprayer for personal products using a replaceable product-filled cartridge. The finger-operated control simultaneously opens the valve, allowing flow of material, and actuates the motor for pumping the material.

This patent describes a rechargeable, battery-powered sprayer using a replaceable product-filled cartridge. This patent also does not have the capability to spray from an internal source or suck liquid from an external source through a suction tube when larger quantities are required.

U.S. Pat. No. 3,565,344 of Hisao Takel describes that in an electric sprayer, a valve system is provided in the liquid path between an opening of an electric pump and a jet of a nozzle. The valve system is connected to the on/off switch of the electric pump so as to keep the system closed when the switch is off (i.e., when the sprayer is not in use), to prevent leakage of spraying liquid from the nozzle jet due to the increased pressure within the container when the atmospheric temperature rises or when the sprayer is inverted.

This patent describes an electric sprayer that does not have the capability to spray from an internal source or suck liquid from an external source through a suction tube when larger quantities are required.

U.S. Pat. No. 8,495,770 of Ryouiehi Kogo et al. describes a nozzle device with a spray hole for spraying washing water and a pipe forming a first flow path that introduces the washing water to the spray hole that is provided. Further, the spray hole is provided in a cover that surrounds the pipe. The cover is integrally formed of a cylindrical metal whose front end is closed. A space between an outer surface of the pipe and an inner peripheral surface of the cover member forming a second flow path that introduces the washing water to the spray hole. Further, the second flow path surrounds surface of the pipe in a circumferential direction of the cover member.

This patent describes a nozzle device with a spray hole for spraying washing water but does not describe a complete spraying device that has the capabilities of the Multi-Use Portable Hand-Held Sprayer.

U.S. Pat. No. 3,901,449 of Carl E. Bochmann describes an electric sprayer comprising a tank having a housing extending over portions of the tank and a piston pump extending into the tank. The pump has an inlet and an outlet. Discharge equipment including a spray nozzle is mounted to an exterior surface of the housing. The discharge equipment is connected to an elastomeric tube surrounded by a coil spring which, in turn, is connected to a slender elongated tube connected to the pump outlet. A motor driven by a set of rechargeable batteries is mounted in the housing and is connected to the pump. An on/off switch electrically interconnecting the batteries and motor is mounted to an exterior surface of the housing. The discharge equipment includes portions pivotally mounted to the housing exterior surface so as to permit movement between a first inoperative position wherein the discharge equipment shields the on/off switch to a second operative position wherein the switch is exposed.

This patent describes an electric sprayer but does not describe a device that is compact and can be Hand-Held for a number of different spraying operations.

None of the foregoing prior art teaches or suggests the particular unique features of the Multi-Use Portable Hand-Held Sprayer and thus clarifies the need for further improvements in the devices that can be used effectively to spray a wide variety of liquids.

In this respect, before explaining at least one embodiment of the Multi-Use Portable Hand-Held Sprayer in detail it is to be understood that the design is not limited in its application to the details of construction and to the arrangement of the components set forth in the following description or illustrated in the drawings. The Multi-Use Portable Hand-Held Sprayer is capable of other embodiments and of being practiced and carried out in various ways. Also, it is to be understood that the phraseology and terminology employed herein are for the purpose of description and should not be regarded as limiting.

SUMMARY OF THE INVENTION

The principle advantage of the Multi-Use Portable Hand-Held Sprayer is having a cordless sprayer that can effectively spray a wide variety of different liquids, configured in differing sizes for differing uses.

And another advantage of the Multi-Use Portable Hand-Held Sprayer is being able to source various liquids as required from an external liquid source through a suction tube when larger quantities are required, or source liquids from an on-board internal reservoir fillable with any desired liquids to be sprayed for any desired purpose.

Another advantage of the Multi-Use Portable Hand-Held Sprayer is that it can be used for many personal hygiene processes.

Another advantage is to create a Multi-Use Portable Hand-Held Sprayer that can be used in the medical fields for cleansing or applying medications to body surfaces.

Another advantage is having a Multi-Use Portable Hand-Held Sprayer that can be used to spray or mist household plants, and residential garden products such as fertilizers and insecticides.

Another advantage is having a Multi-Use Portable Hand-Held Sprayer that can be used to spray home, vehicle and business cleaning products.

And another advantage of the Multi-Use Portable Hand-Held Sprayer is that it can be used to spray a cooling mist when a person is overheated.

A further advantage of the Multi-Use Portable Hand-Held Sprayer is being made from non-corrosive materials that will not be affected by fluids containing salts or acids.

The preferred embodiment of the large size Multi-Use Portable Hand-Held Sprayer will consist of the sprayer main internal parts frame with motor frame mount, a motor assembly including the motor shaft gear that meshes with the bull gear. The bull gear is connected to the pump assembly, pump piston crank shaft and fluid flow tube (pump to nozzle). A suction tube (liquid source to pump) is used to suck liquid from an external source. At the top of the sprayer main internal parts frame, is the nozzle extension tube receiver.

The large size Multi-Use Portable Hand-Held Sprayer housing will enclose the sprayer main internal parts frame, including the on-off switch assembly having the power indicator light, on-off switch and nozzle release switch. The nozzle extension tube receiver is at the upper end of the sprayer main internal parts frame. The nozzle tube connection ratchet engages within the nozzle extension tube receiver and connects with the nozzle extension tube with the nozzle spray head on the end. The nozzle spray head is adjustable from a fine mist spray pattern to a strong concentrated direct line of liquid spray pattern.

The first alternate embodiment of the medium size Multi-Use Portable Hand-held Sprayer will have all the same internal components except the capability of sucking liquid from an external source through the external suction tube. This pick-up suction tube is attachable to a hose, and the end of the attached hose can be dipped in any liquid source.

The second alternate embodiment will be the small size Multi-Use Portable Hand-Held Sprayer having the power indicator light, on-off switch and the nozzle release switch on the sprayer housing. It will have the same internal components except the capability of sucking liquid from an external source. The nozzle extension tube with the nozzle spray head is at the top. An internal refillable liquid container reservoir will be contained within the housing of the device and fillable through a fill lid located at the lower end of the device housing.

The third alternate embodiment will be the mini size Multi-Use Portable Hand-Held Sprayer having the power indicator light, on-off switch and the nozzle release switch on the housing. It will have the same internal components except the capability of sucking liquid from an external source. The nozzle extension tube with the nozzle spray head is at the top. An internal refillable liquid container will be at the lower end of the device.

All of the anticipated Multi-Use Portable Hand-Held Sprayer sizes, mini, small, medium and large will have multiple uses depending upon the liquids to be sprayed and the requirements of the user. In this regard, the present invention could be used in any capacity, and in any setting including but not limited to the following places:

Child Care Facility
Nursing Home Facility
In Home Caregiving
Doctors and Specialists offices
Hospitals
Morgues
Clinics
Social Gatherings
Workplace Gatherings
Sports Gatherings
School Gatherings
Political Gatherings
Protest Gatherings
Demonstration Gatherings
Rally Gatherings
Workplace Gatherings
Office Gatherings
Church Gatherings All of the anticipated Multi-Use Portable Hand-Held Sprayer sizes, mini, small, medium and large will have multiple uses depending upon the liquids to be sprayed and the requirements of the user. In this regard, the present invention could be used to or for:

Personal Portable Personal Safety
Eye washing, cleansing, rinsing
Skin washing, cleansing, rinsing
Ear washing, cleansing, rinsing
Nasal washing, cleansing, rinsing
Sun burn, Insect bites, animal bites topical treatment
Replenishing dehydration
Extinguishing small fires
Animal repellant, Insect repellent application
Personal Portable Shower
Personal Portable Bidet
Personal Portable Toothbrush Personal Portable Wound Cleaner
Personal Portable Ear and Ear Canal Cleaner
Personal Portable Eye and Emergency Eye Wash Cleaner
Personal Portable Nasal Passage Cleaner
Personal Portable Feminine Hygiene Cleaner
Personal Portable Means to Clean Around the house
Personal Portable Means to Clean Vehicles (autos, trucks, etc.) and Recreational Vehicle
Personal Portable Means to Clean Boats and other vessels and watercraft
Personal Portable Means to Clean Buses and Aircraft including drones
Personal Portable Means to provide water from Internal or External Water Supply for the purposes of cooling off the human body externally by use of direct water or form of misting. Direct water can be used for hydrating or rehydrating purposes
Personal Portable Means to Clean, Drain, Supply water for the purposes of work projects (marking, painting, lubrication, applying stains and finishes, etc.) and for meeting hobby needs
Personal Portable Means to Rinse, Clean, Final and Continuing final rinse for mechanical parts needs
Personal, Portable means to provide rinsing, washing and final or continual rinsing or other purposes with water for providing those needs to plants, pets and animals Additionally, Multi-Use Portable Hand-Held Sprayer can provide a personal, portable means of providing a liquid dispenser, for the following liquids to name a few:

Alcoholic beverages
Non-Alcoholic beverages
Carbonated beverages
Non-Carbonated beverages
Fruit juices
Vegetable juices
Water based beverages
Dairy
Holistic liquid agents
Liquid smoke
Liquid food extracts
Liquid food dyes
Liquid hot sauce
Salad dressings
Condiments
Food color dye
Butter spray
Natural occurring liquid agents
Medicinal liquids (applying body, hair and foot treatment liquids)
Antiseptic liquids
Insect/Pest repelling liquids With respect to the above description then, it is to be realized that the optimum dimensional relationships for the parts of the Multi-Use Portable Hand-Held Sprayer, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present design. Therefore, the foregoing is considered as illustrative only of the principles of the design. Further, since numerous modifications and changes will readily occur to those skilled in the art, it is not desired to limit the Multi-Use Portable Hand-Held Sprayer to the exact construction and operation shown and described, and accordingly, all suitable modifications and equivalents may be resorted to, falling within the scope of this application.

BRIEF DESCRIPTION OF THE DRAWINGS

The accompanying drawings, which are incorporated in and form a part of this specification, illustrate embodiments of the Multi-Use Portable Hand-Held Sprayer and together with the description, serve to explain the principles of this application.

DETAILED DESCRIPTION OF THE PREFERRED EMBODIMENTS

As required, detailed embodiments of the present application are disclosed herein, however, it is to be understood that the disclosed embodiments are merely exemplary of the design that may be embodied in various forms. Therefore, specific functional and structural details disclosed herein are not to be interpreted as limiting, but merely as basic for the claims and as a representative basis for teaching one skilled in the art to variously employ the present embodiments of the Multi-Use Portable Hand-Held Sprayers 10A, 10B, 10C and 10D in virtually any appropriately detailed structure.

Figure 1:
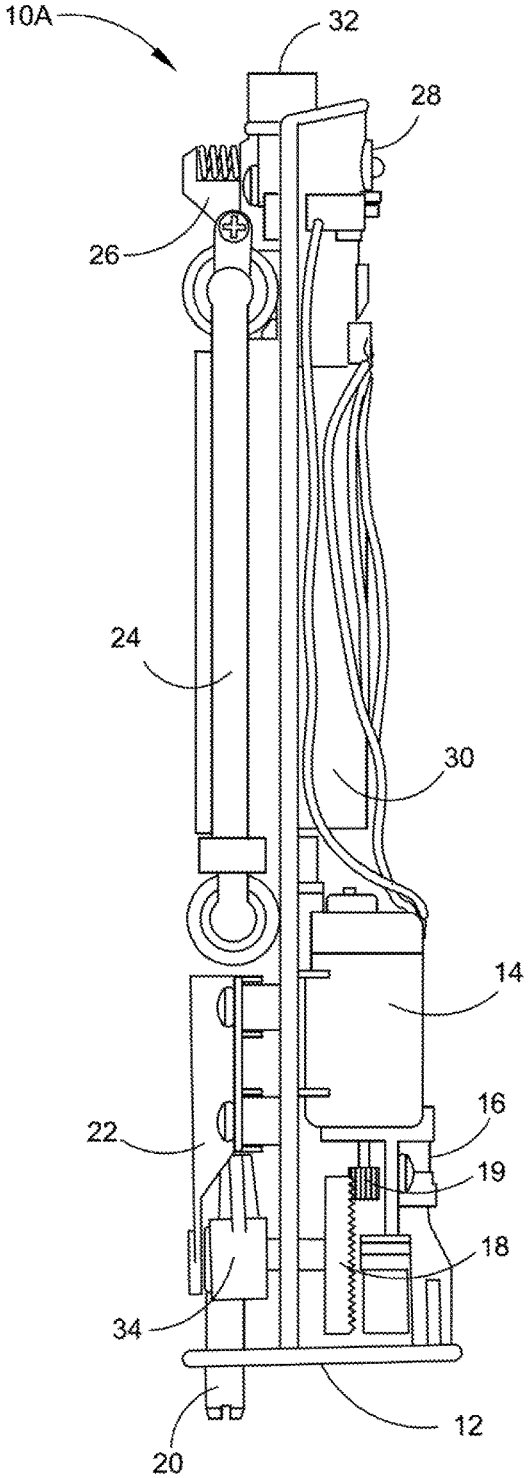
FIG. 1 depicts a side view of the internal parts of the large size Multi-Use Portable Hand-Held Sprayer.

FIG. 1 depicts a side view of the internal parts of the large size Multi-Use Portable Hand-Held Sprayer 10A illustrating the sprayer main internal parts frame 12 with the motor assembly 14, motor frame mount 16 showing where the motor shaft gear 19 meshes with the bull gear 18. On the right side of the sprayer main internal parts frame 12 is the pump assembly 22, pump piston crank shaft 34, fluid flow tube (pump to nozzle) 24 and the on-off switch assembly 28. At the bottom is the lower suction tube (liquid source to pump) 20 and on top is the nozzle extension tube receiver 32. All of the disclosed Multi-Use Portable Hand-Held Sprayer are constructed using non-corrosive materials that will not be affected by fluids containing salts or acids.

Figure 2:
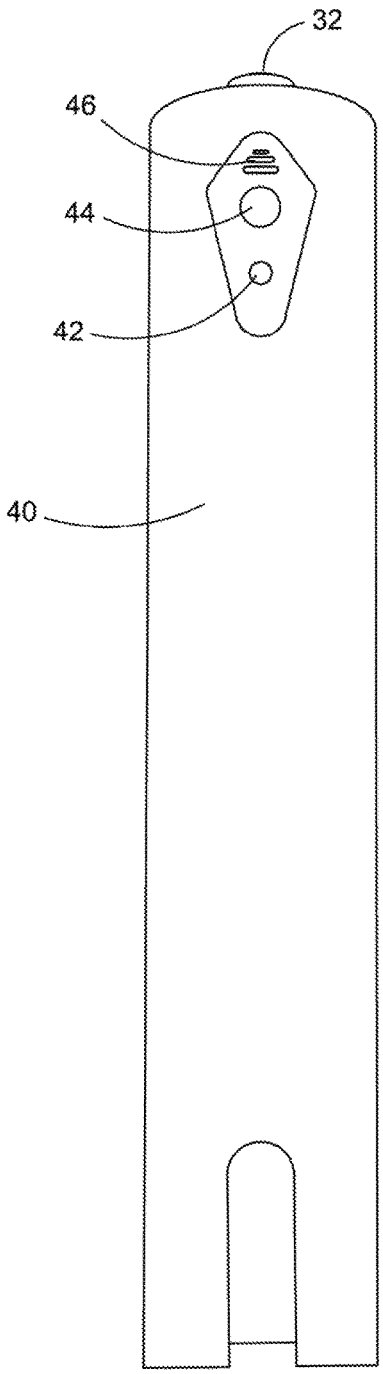
FIG. 2 depicts a top plan view of the large size Multi-Use Portable Hand-Held Sprayer housing.

FIG. 2 depicts a top plan view of the large size Multi-Use Portable Hand-Held Sprayer 10A with the large sprayer housing 40, the power indicator light 42, on-off switch 44 nozzle release switch 46 and the nozzle extension tube receiver 32 at the top.

Figure 3:
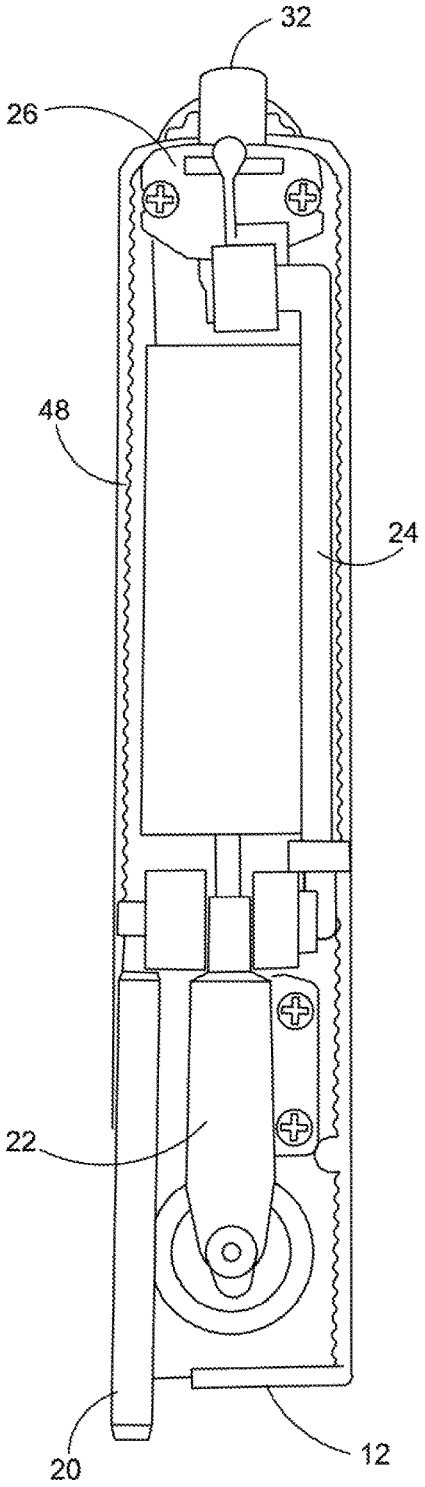
FIG. 3 depicts bottom view of the large size Multi-Use Portable Hand-Held Sprayer illustrating the internal parts.

FIG. 3 depicts bottom view of the large size Multi-Use Portable Hand-Held Sprayer 10A internal parts illustrating the locations of the sprayer main internal parts frame 12 with the rubber seal 48 around the perimeter edge. The piston crankshaft receiver mount 34 connects to the lower suction tube (liquid source to pump) 20 and the lower suction tube (pump to nozzle) 24 to transmit the fluid through the fluid flow control valve 26 and out through the nozzle extension tube receiver 32.

Figure 4:
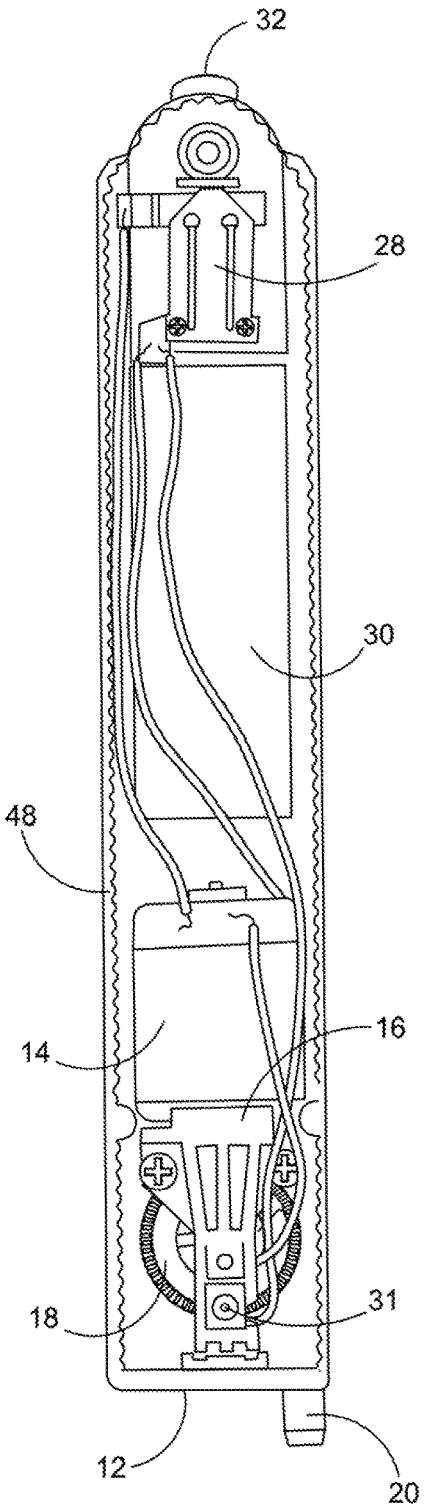
FIG. 4 depicts top view of the large size Multi-Use Portable Hand-Held Sprayer illustrating the internal parts.

FIG. 4 depicts top view of the large size Multi-Use Portable Hand-Held Sprayer 10A internal parts illustrating the locations of the sprayer main internal parts frame 12 with the rubber seal 48 around the perimeter edge. The motor assembly 14 with the motor shaft gear 19 is engaged with the bull gear 18 by the means of the motor frame mount 16. The rechargeable battery pack 30 is connected to the battery charger port 31, the motor assembly 14 and the on-off switch assembly 28. The lower suction tube (liquid source to pump) 20 extends below the surface of the sprayer main internal parts frame 12.

Figure 5:
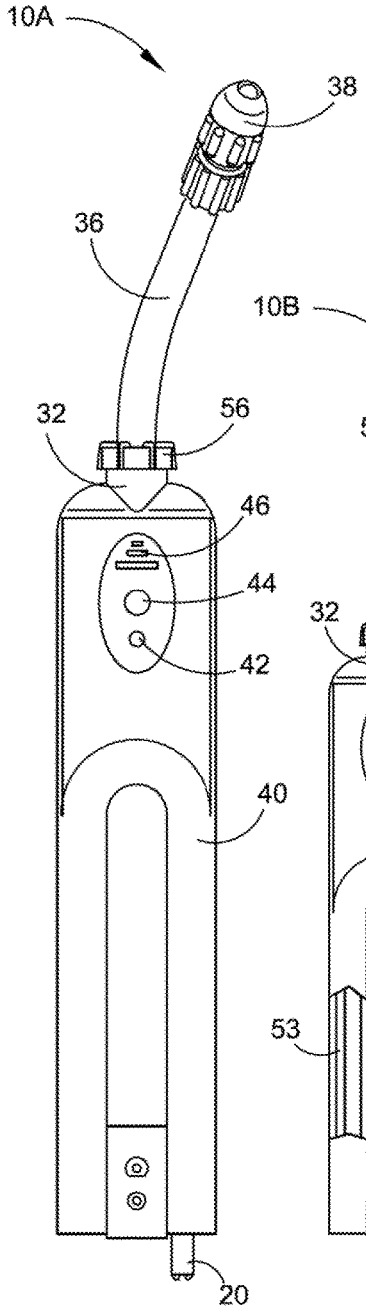
FIG. 5 depicts front view of the preferred embodiment of the large size Multi-Use Portable Hand-Held Sprayer.

FIG. 5 depicts front view of the preferred embodiment of the large size Multi-Use Portable Hand-Held Sprayer 10A illustrating the locations of the power indicator light 42, on-off switch 44 and the nozzle release switch 46 on the 10A large size Sprayer housing 40 with the lower suction tube (liquid source to pump) 20 on the bottom. The 10A nozzle tube connection ratchet 56 engages with the nozzle extension tube receiver 32 and the 10A removeable and replaceable nozzle extension tube 36 with the 10A removeable and replaceable nozzle spray head 38 at the top. The nozzle release switch 46 when activated by pushing, enables the removeable and replaceable nozzle extension tube 36 and the removeable and replaceable nozzle spray head 38 to be readily removed and replaced. For more detail on the construction and operation of the removeable and replaceable nozzle extension tube 36 see FIG. 9. The nozzle spray head 38 is adjustable from a fine mist spray pattern to a strong concentrated direct line of liquid spray pattern.

Figure 6:
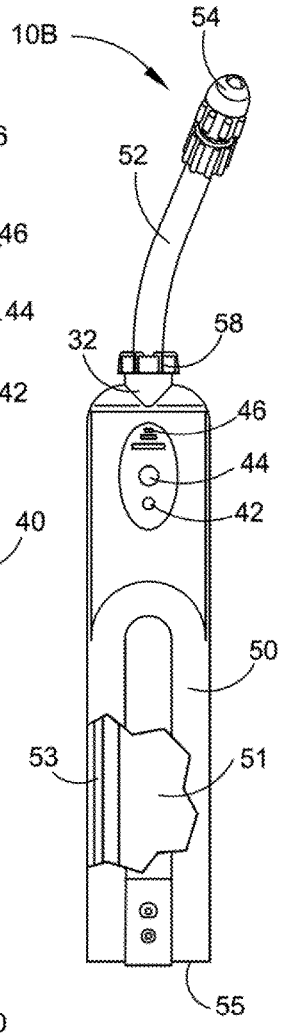
FIG. 6 depicts front view of the first alternate embodiment of the medium size Multi-Use Portable Hand-Held Sprayer including an internal reservoir for containing liquid therein.

FIG. 6 depicts front view of the first alternate embodiment of the medium size Multi-Use Portable Hand-Held Sprayer 10B illustrating the locations of the power indicator light 42, on-off switch 44 and the nozzle release switch 46 on the 10B medium size Sprayer housing 50. The 10B nozzle tube connection ratchet 58 engages with the nozzle extension tube receiver 32 and the 10A removeable and replaceable nozzle extension tube 52 with the 10B removeable and replaceable nozzle spray head 54 at the top. The nozzle release switch 46 when activated by pushing, enables the removeable and replaceable nozzle extension tube 52 and the removeable and replaceable nozzle spray head 54 to be readily removed and replaced. For more detail on the nozzle release switch 46 see FIG. 9. The broken away section of Sprayer housing 50 reveals and internal reservoir assembly 51 and an internal reservoir fluid transfer tube 53. The internal reservoir assembly 51 is filled by holding the sprayer upside-down and pouring fluid through fill door 55 (not shown). The internal reservoir assembly 51 is comprised of two separate compartments, a watertight fluid containing compartment and a mechanism compartment for housing the motor pump and battery. The fluid is contained within the watertight compartment and the mechanism is kept dry. This is further described in more detail in FIG. 13 and FIG. 14.

Figure 7:
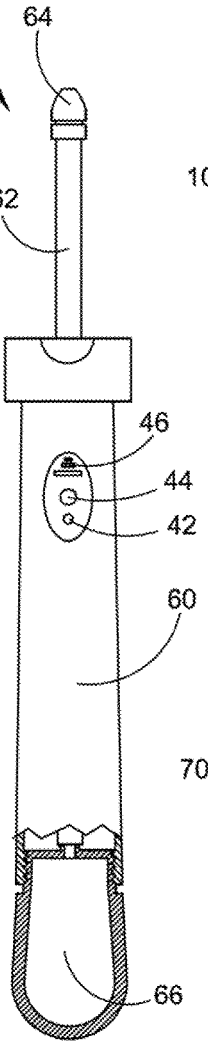
FIG. 7 depicts front view of the second alternate embodiment of the small size Multi-Use Portable Hand-Held Sprayer.

FIG. 7 depicts front view of the second alternate embodiment of the small size Multi-Use Portable Hand-Held Sprayer 10C illustrating the locations of the power indicator light 42, on-off switch 44 and the nozzle release switch 46 on the 10B medium size Sprayer housing 60. The 10C removeable and replaceable nozzle extension tube 62 with the 10C removeable and replaceable nozzle spray head 64 is at the top. The nozzle release switch 46 when activated by pushing, enables the removeable and replaceable nozzle extension tube 62 and the removeable and replaceable nozzle spray head 64 to be readily removed and replaced. For more detail on the nozzle release switch 46 see FIG. 9. An internal refillable fluid container 66 will be at the lower end of the device.

Figure 8:
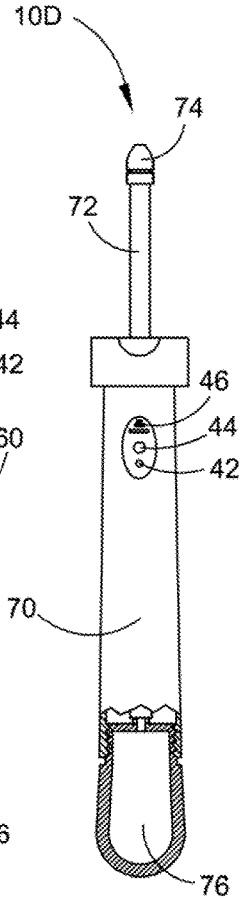
FIG. 8 depicts front view of the third alternate embodiment of the mini Multi-Use Portable Hand-Held Sprayer.

FIG. 8 depicts front view of the third alternate embodiment of the mini Multi-Use Portable Hand-Held Sprayer 10D illustrating the locations of the power indicator light 42, on-off switch 44 and the nozzle release switch 46 on the 10B medium size Sprayer housing 70. The 10D removeable and replaceable nozzle extension tube 72 with the 10D removeable and replaceable nozzle spray head 74 is at the top. The nozzle release switch 46 when activated by pushing, enables the removeable and replaceable nozzle extension tube 72 and removeable and replaceable nozzle spray head 74 to be readily removed and replaced. For more detail on the nozzle release switch 46 see FIG. 9. An internal refillable fluid container 66 will be at the lower end of the device.

Figure 9:
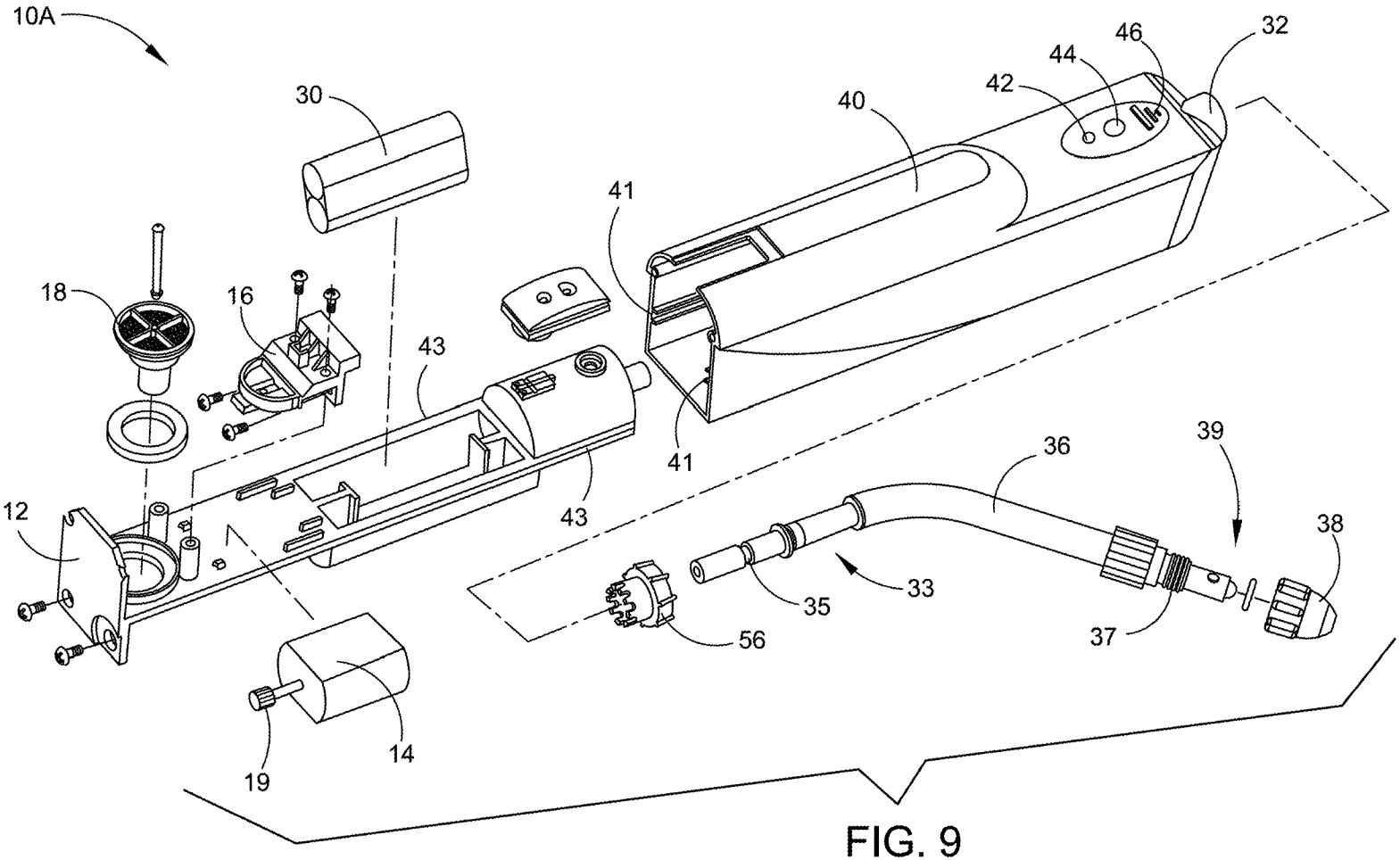
FIG. 9 depicts an exploded perspective view of the preferred embodiment of the large size Multi-Use Portable Hand-Held Sprayer.

FIG. 9 depicts an exploded perspective view of the preferred embodiment of the large size Multi-Use Portable Hand-Held Sprayer 10A illustrating the locations of the sprayer main internal parts frame 12 with the motor assembly 14 and motor shaft gear 19 that meshes with the bull gear 18. The motor assembly 14 is held in place by the means of the motor frame mount 16. The rechargeable battery pack 30 sits securely within a cavity in the sprayer main internal parts frame 12 that will slide within the 10A large Sprayer housing 40. Sprayer housing 40 includes housing rail accepting slots 41 running from top to bottom on the side walls in the interior of the sprayer housing 40. Sprayer main internal parts frame 12 has integral rails 43 running from top to bottom on both sides of sprayer main internal parts frame 12. The Multi-Use Portable Hand-Held Sprayer 10A is assembled by sliding the frame 12 into the housing 40 by sliding the frame rails 43 integral to frame 12 into and along housing rail accepting slots 41 within the interior of the housing 40. The housing 40 is then secured to the frame 12 using screws located at the base of frame 12.

Nozzle extension tube 36 includes a nozzle accepting portion 39 having a nozzle accepting threaded section 37 for accepting a nozzle head 38. To replace the nozzle head 38 the old nozzle head is unthreaded from the threaded section 37 and removed and the new nozzle head is threaded back on to the threaded section 37. On the opposite end, nozzle extension tube 36 has an extension tube insertion section 33 including an extension tube insertion section slot 35. To replace the nozzle extension tube 36, activation switch 46 is pushed and the extension tube insertion portion slot 35 is released enabling the extension tube insertion section 33 to slide out of the housing nozzle extension tube receiver 32. In this way, both the extension tube and the nozzle head are readily removeable and replaceable. It is anticipated that varying lengths of the extension tubes and varying spray heads will be employed, as seen in FIGS. 5-8.

Figure 10:
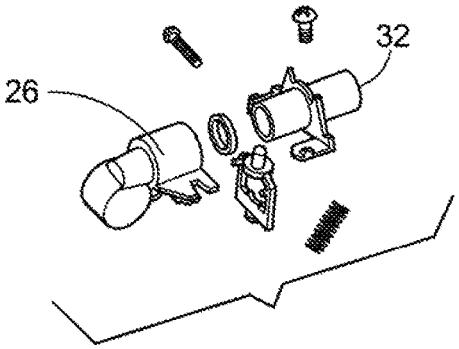
FIG. 10 depicts an exploded perspective view of the fluid flow control valve.

FIG. 10 depicts an exploded perspective view of the fluid flow control valve 26 with the nozzle extension tube receiver 32.

Figure 11:
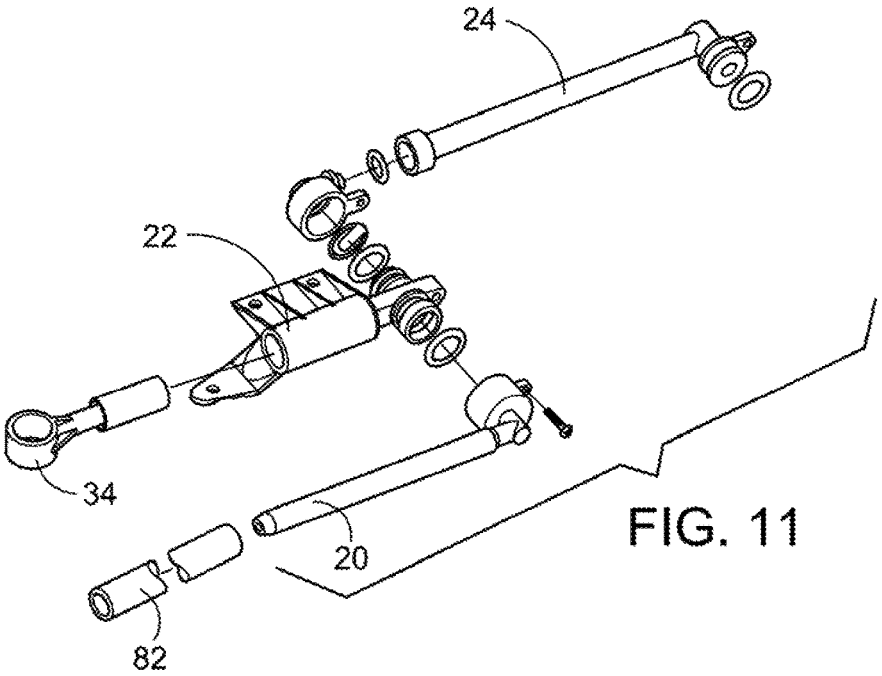
FIG. 11 depicts an exploded perspective view of the pump assembly.

FIG. 11 depicts an exploded perspective view of the pump assembly 22, Fluid flow tube (pump to nozzle) 24, lower suction tube (liquid source to pump) 20 and fluid suction tube 82.

Figure 12:
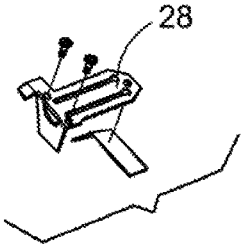
FIG. 12 depicts a perspective view of the On-off switch assembly.

FIG. 12 depicts a perspective view of the on-off switch assembly 28.

Figure 13:
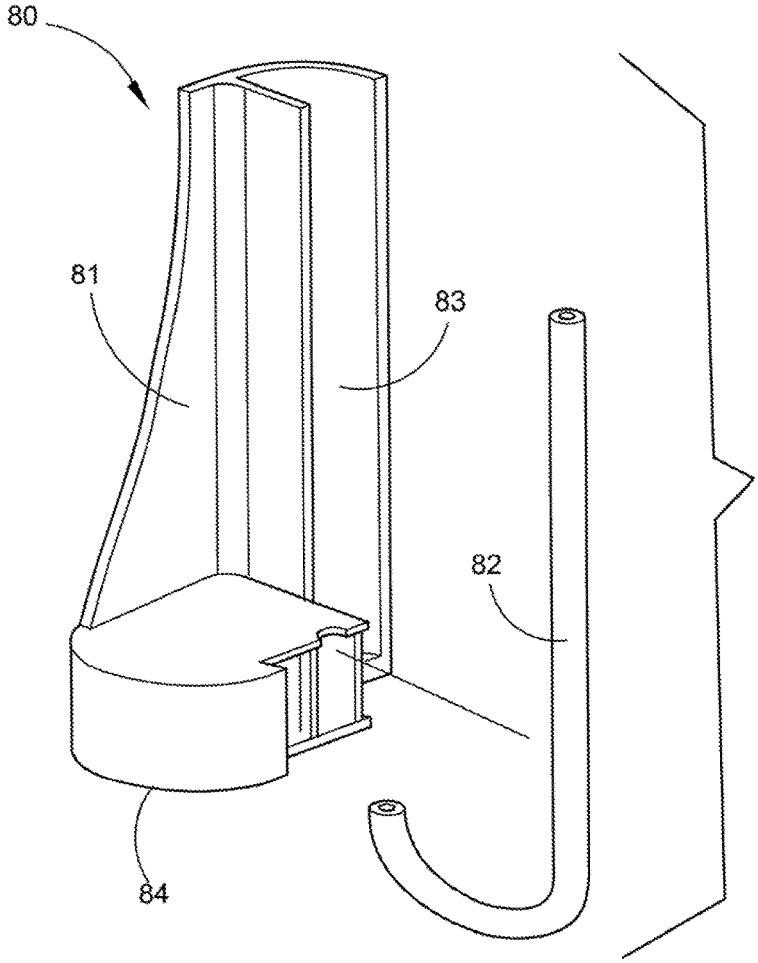
FIG. 13 depicts a perspective cross section of the internal on-board reservoir assembly fluid container with the fluid suction tube, illustrating the two compartments therein.

FIG. 13 depicts a perspective cross section of the internal on-board reservoir assembly 80 with the fluid suction tube 82 broken out. The internal on-board reservoir assembly 80 is housed within the sprayer units having on-board reservoirs to contain liquids therein. The internal on-board reservoir assembly 80 is comprised of two separate compartments, a watertight fluid containing compartment 81 and a dry mechanism containing compartment 83, for housing the motor assembly, pump assembly and rechargeable battery in a dry environment. The fluid is contained within the watertight compartment 81 and the mechanism compartment 83 is kept dry. The internal on-board reservoir assembly 80 of FIG. 13 is filled by holding the sprayer unit upside-down and pouring fluid through fill door 84 (pointed to but not shown here in this FIG. 13 perspective view, see detail on this fluid fill door 84 in FIG. 14 below).

Figure 14:
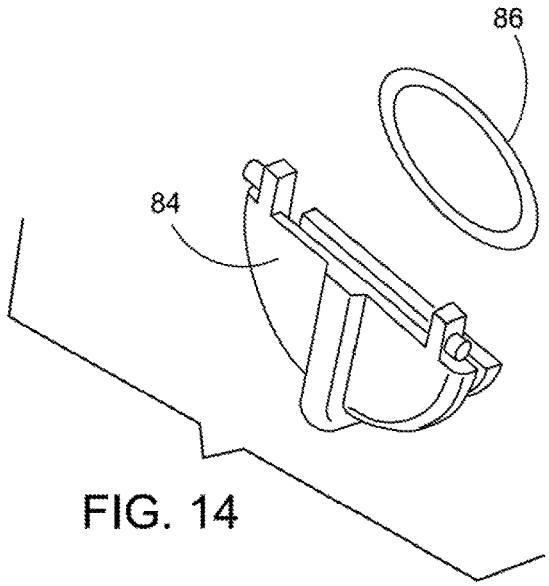
FIG. 14 depicts perspective view of the internal reservoir fluid fill lid and O-ring.

FIG. 14 depicts perspective view of the additional fluid container lid 84 with the fill lid O-ring 86. The internal on-board reservoir assembly 80 of FIG. 13 is filled by holding the sprayer unit upside-down and pouring fluid through fill door 84 and is sealed to prevent leakage by O-ring 86.

The Multi-Use Portable Hand-Held Sprayer 10A, 10B, 10C and 10D shown in the drawings and described in detail herein disclose arrangements of elements of particular construction and configuration for illustrating preferred embodiments of structure and method of operation of the present design. It is to be understood, however, that elements of different construction and configuration and other arrangements thereof, other than those illustrated and described may be employed for providing a Multi-Use Portable Hand-Held Sprayer 10A, 10B, 10C and 10D in accordance with the spirit of this application, and such changes, alternations and modifications as would occur to those skilled in the art are considered to be within the scope of this application as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. A multi-use portable hand-held sprayer comprising:

(a) a housing having an upper portion and a lower portion with side walls, including an interior portion having rail slots configured to accept rails running along said side walls, an open bottom portion with an open slot located in said bottom portion and a nozzle extension tube receiver opening including a nozzle tube connection ratchet in said upper portion, and further including a nozzle release switch;

(b) a frame including frame rails integral to said frame configured to slide into said rail slots located on said interior portion of said housing, having a motor assembly mounted thereon, including a pump assembly mounted on said frame wherein said pump includes a fluid source tube attached thereto, a battery compartment housing a battery, fluid flow tubes extending from said pump to a fluid flow control valve and to said nozzle extension tube, and an on/off switch; and (c) an external removeable replaceable nozzle extension tube having an upper portion having a threaded nozzle accepting section and a lower portion having an extension tube insertion section which engages with said nozzle extension tube receiver opening located on said housing, further including an extension tube insertion slot, wherein an external removeable replaceable nozzle is attached to said extension tube upper portion;

wherein said frame is inserted into the open bottom of housing and said external removeable replaceable extension tube lower portion insertion section is attached to said external removeable replaceable nozzle extension tube receiver opening, whereby when fluid is available from said fluid source tube, the on/off switch is turned on to activate the motor powered by the battery which actuates the pump causing fluid to flow through said fluid flow tubes and said fluid flow control valve, through said nozzle extension tube, out through said nozzle and further wherein said external removeable replaceable nozzle extension tube and said external removeable replaceable nozzle is configured to be readily removed and replaced.

2. The multi-use portable hand-held sprayer according to claim 1, wherein said fluid source tube includes a fluid pick-up tube having a hose connect portion extending outside said housing and said frame, capable of sourcing external fluids from outside the housing, and delivering liquid to said pump when said motor is powered to actuate said pump.

3. The multi-use portable hand-held sprayer according to claim 1, wherein said housing is configured to enclose an on-board internal reservoir to contain fluid therein.

4. The multi-use portable hand-held sprayer according to claim 3, wherein said reservoir further includes a fluid source tube attached thereto, and said reservoir is thereby in fluid communication with said pump.

5. The multi-use portable hand-held sprayer according to claim 1, wherein said motor assembly further includes a motor attached to said frame, a motor shaft gear connected to a bull gear wherein said bull gear is connected to a pump piston crank shaft on said pump assembly, whereby said motor drives said motor shaft gear which in turn rotates said bull gear actuating said pump piston crank shaft.

6. The multi-use portable hand-held sprayer according to claim 1, wherein said external removeable and replaceable nozzle is adjustable from a fine mist spray to a direct line strong spray.

7. The multi-use portable hand-held sprayer according to claim 1, wherein said frame is configured in multiple sizes, including mini, small, medium and large sizes for multiple uses.

8. The multi-use portable hand-held sprayer according to claim 1, wherein said housing, frame, fluid flow tube, fluid flow control valve, external removeable and replaceable nozzle extension tube and external removeable and replaceable nozzle are all constructed of non-corrosive materials.

9. The multi-use portable hand-held sprayer according to claim 1, wherein said motor assembly is powered by said battery, and further wherein said battery is rechargeable.

10. The multi-use portable hand-held sprayer according to claim 1, wherein said frame includes a battery charge port and said housing slot exposes said charge port wherein said battery is rechargeable by connection with said charge port.

11. A method for making a multi-use portable hand-held sprayer, comprising the steps of:

(a) providing a housing having an upper portion and a lower portion with side walls, including an interior portion having rail slots configured to accept rails running along said side walls, an open bottom portion with an open slot located in said bottom portion and a nozzle extension tube receiver opening including a nozzle tube connection ratchet in said upper portion, and further including a nozzle release switch;

(b) providing a frame including frame rails integral to said frame configured to slide into said rail slots located on said interior portion of said housing, having a motor assembly mounted thereon, including a pump assembly mounted on said frame wherein said pump includes a fluid source tube attached thereto, a battery compartment housing a battery, fluid flow tubes extending from said pump to a fluid flow control valve and to said nozzle extension tube, and an on/off switch; and (c) providing an external removeable replaceable nozzle extension tube having an upper portion having a threaded nozzle accepting section and a lower portion having an extension tube insertion section which engages with said nozzle extension tube receiver opening located on said housing, further including an extension tube insertion slot, wherein an external removeable replaceable nozzle is attached to said extension tube upper portion;

(d) assembling said frame and said housing by inserting said frame into said housing by sliding said rails integral to said frame configured to slide into said rail slots located on said interior portion of said housing into said rail slots located on said interior portion of said housing and securing said frame to said housing;

(e) inserting said external removeable replaceable nozzle extension tube into said nozzle extension tube receiver opening including a nozzle tube connection ratchet; and (f) threading an external removeable replaceable nozzle on to said external removeable replaceable nozzle extension tube having an upper portion having a threaded nozzle accepting section;

wherein said frame is inserted into the open bottom of housing and said external removeable replaceable extension tube lower portion insertion section is attached to said external removeable replaceable nozzle extension tube receiver opening, whereby when fluid is available from said fluid source tube, the on/off switch is turned on to activate the motor powered by the battery which actuates the pump causing fluid to flow through said fluid flow tubes and said fluid flow control valve, through said nozzle extension tube, out through said nozzle and further wherein said external removeable replaceable nozzle extension tube and said external removeable replaceable nozzle is configured to be readily removed and replaced.

12. The method of making a multi-use portable hand-held sprayer according to claim 11, wherein said fluid source tube includes a fluid pick-up tube having a hose connect portion extending outside said housing and said frame, capable of sourcing external fluids from outside the housing, and delivering liquid to said pump when said motor is powered to actuate said pump.

13. The method of making a multi-use portable hand-held sprayer according to claim 11, wherein said housing is configured to enclose an on-board internal reservoir to contain fluid therein.

14. The method of making a multi-use portable hand-held sprayer according to claim 13, wherein said reservoir further includes a fluid source tube attached thereto, and said reservoir is thereby in fluid communication with said pump.

15. The method of making a multi-use portable hand-held sprayer according to claim 11, wherein said motor assembly further includes a motor attached to said frame, a motor shaft gear connected to a bull gear wherein said bull gear is connected to a pump piston crank shaft on said pump assembly, whereby said motor drives said motor shaft gear which in turn rotates said bull gear actuating said pump piston crank shaft.

16. The method of making a multi-use portable hand-held sprayer according to claim 11, wherein said external removeable and replaceable nozzle is adjustable from a fine mist spray to a direct line strong spray.

17. The method of making a multi-use portable hand-held sprayer according to claim 11, wherein said frame is configured in multiple sizes, including mini, small, medium and large sizes for multiple uses.

18. The method of making a multi-use portable hand-held sprayer according to claim 11, wherein said housing, frame, fluid flow tube, fluid flow control valve, external removeable and replaceable nozzle extension tube and external removeable and replaceable nozzle are all constructed of non-corrosive materials.

19. The method of making a multi-use portable hand-held sprayer according to claim 11, wherein said motor assembly is powered by said battery, and further wherein said battery is rechargeable.

20. The method of making a multi-use portable hand-held sprayer according to claim 11, wherein said frame includes a battery charge port and said housing slot exposes said charge port wherein said battery is rechargeable by connection with said charge port.

* * * * *